US006413106B1

(12) United States Patent
Yu

(10) Patent No.: US 6,413,106 B1
(45) Date of Patent: Jul. 2, 2002

(54) CARD CONNECTOR HAVING EJECTION MECHANISM WITH TWO EJECTION DRAWER PLATES

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/902,864

(22) Filed: Jul. 10, 2001

(30) Foreign Application Priority Data

Mar. 23, 2001 (TW) ..... 090204410

(51) Int. Cl.[7] ..... H01R 13/62
(52) U.S. Cl. ..... 439/159; 439/157
(58) Field of Search ..... 439/152, 153, 439/154, 155, 156, 157, 158, 159, 160

(56) References Cited

U.S. PATENT DOCUMENTS 5,683,258 A * 11/1997 Takano et al. ..... 439/159
5,899,763 A * 5/1999 Kajiura ..... 439/159
5,984,702 A * 11/1999 Nishioka ..... 439/159
6,036,513 A * 3/2000 Nishioka ..... 439/159
6,036,514 A * 3/2000 Nishioka ..... 439/159
6,113,403 A * 9/2000 Oguchi ..... 439/159
6,120,309 A * 9/2000 Hara ..... 439/159

* cited by examiner

*Primary Examiner*—Tulsidas Patel
(74) *Attorney, Agent, or Firm*—Wei Te Chung

(57) ABSTRACT

A card connector (2) includes an insulating housing (3) with two side arms (31) and a connecting arm (33) integral with the side arms, a number of terminals (4) and an ejection mechanism (5). The ejection mechanism includes a push device (51) fixed on one of the side arms, a first drawer plate (53) and a second drawer plate (55). The push device has an opening (512) on one end thereof and the first drawer plate has an actuating end (531) pivotally connected with the push device. The second drawer plate has an operating plate (551) which pivotally connects with the first drawer plate. The first drawer plate and the second drawer plate both provide ejection ends to release an electronic card (6) out of the card connector.

5 Claims, 4 Drawing Sheets

CARD CONNECTOR HAVING EJECTION MECHANISM WITH TWO EJECTION DRAWER PLATES

BACKGROUND OF THE INVENTION

1. Field of the Invention

The present invention is generally related to a card connector, particularly to a card connector which utilizes two ejection drawer plates of an ejection mechanism to release a card from the card connector.

2. Description of the Related Prior Art

Card connectors transfer signals between a printed circuit board and an inserted electronic card. The card may be changed frequently due to a plurality of outer signals that are needed, so the card must be inserted/ejected for many times and a release mechanism of the card connector must be available to achieve the above-mentioned requirements. Related prior art designs can be found in U.S. Pat. Nos. 5,899,763 and 6,120,309. FIG. 5 shows a card connector 1 comprising an insulating housing, a plurality of terminals (not labeled), a shield 13 and a release mechanism 14. The release mechanism 14 includes a manual release device 141, a rocker arm 142 and a drawer plate 143. One end of the rocker arm 142 pivotally connects to the manual release device 141 and the other end of the rocker arm 142 pivotally connects to the drawer plate 143. Pushing the manual release device 141, the rocker arm 142 will rotate about a through hole 1421 of the rocker arm 142 and the drawer plate 143 will move forwardly to eject a card (not shown) out of the card connector 1.

However, the release mechanism 14 performs two phases, in the first phase, rotation of the rocker plate 142 causes the drawer plate 143 moving in a linear translation fashion and the card is moved a first distance. The drawer plate 143 is provided with a projection 1431 and the rocker arm 142 is provided with a corresponding abutting edge which is brought to contact the projection at the end of the first phase. Further actuating the release device 141 causes the drawer plate 143 to rotate with the rocker arm 142 due to the contact engagement and the pivot point therebetween. The second phase of the release operation is thus performed with the rotation of the drawer plate which causes one end to the drawer plate 143 to move thereby driving the card outwards a second distance. But in the second phase, only a release point apart from the rocker arm 142 releases the card and the drawer plate 143 rotates around the through hole 1421, so the card will be crushed against the arm of the insulating housing and it is possible that the resistance therein prevents the card from being released.

BRIEF SUMMARY OF THE INVENTION

Therefore, an object of the present invention is to provide a card connector having an ejection mechanism which has two ejection ends associated with two ejection drawer plates thereof to release a card out of the card connector.

To achieve the above-mentioned object, a card connector in accordance with the present invention comprises an insulating housing with a plurality of terminal passageways, a plurality of terminals and a ejection mechanism. The insulating housing comprises two side arms and a connecting arm integrally formed on an end of each side arm. The connecting arm defines a top face with a first post and a second post vertically extending therefrom. The ejection mechanism comprises a push device, a first drawer plate pivotally connect with one end of the push device and a second drawer plate. The first drawer plate and the second drawer plate have a first hole and a second hole respectively to pivotally connect with the first post and the second post correspondingly. The first drawer plate further comprises a connecting hole and the second drawer plate defines an operating plate connecting pivotally with the connecting hole. The first drawer plate defines a first ejection end far from the push device and the second drawer plate defines a second ejection end adjacent to the push device. The first ejection end and the second ejection end release a card in the card connector synchronously.

Other objects, advantages and novel features of the invention will become more apparent from the following detailed description of the present embodiment when taken in conjunction with the accompanying drawings.

DETAILED DESCRIPTION OF THE INVENTION

Figure 1:
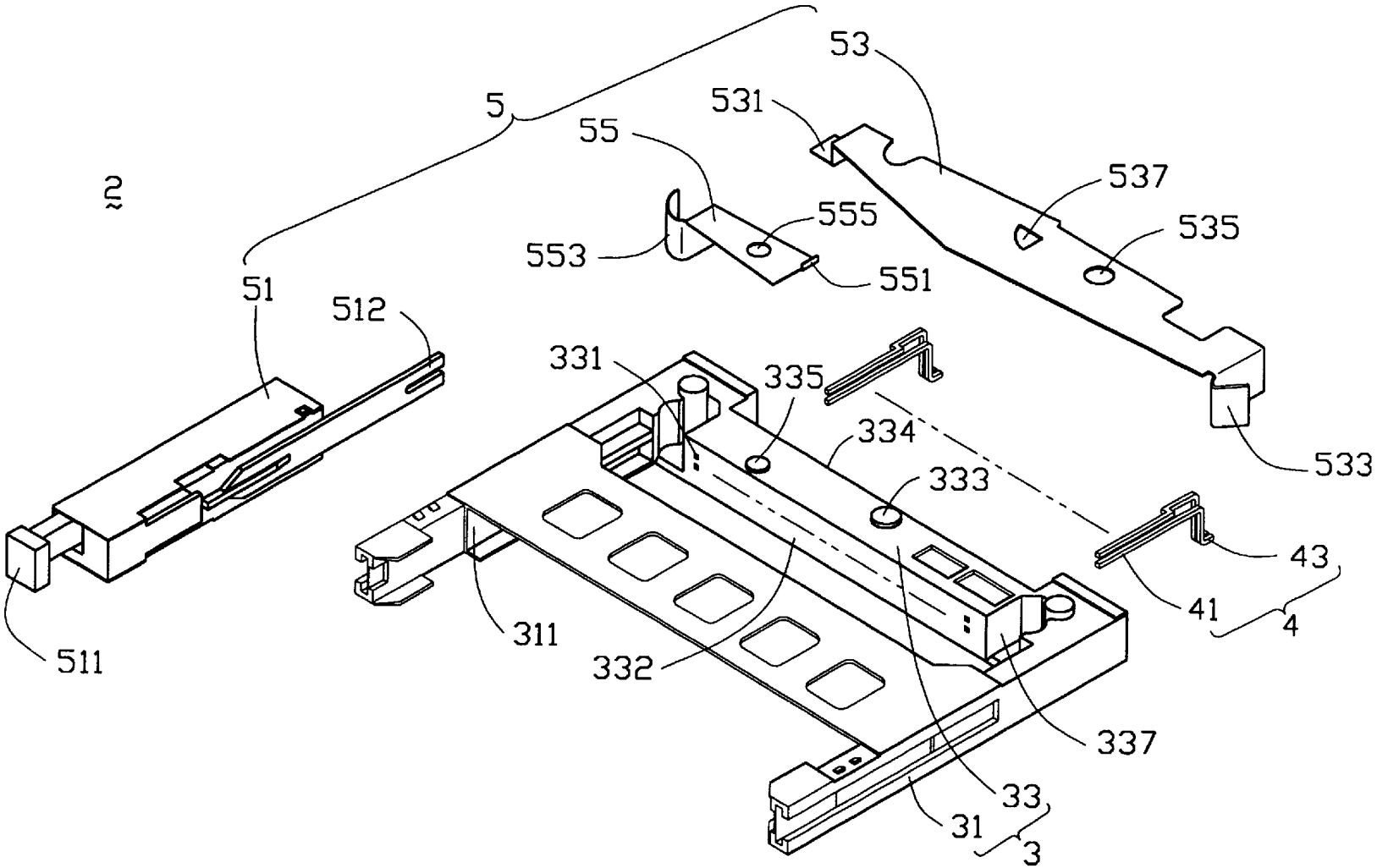
FIG. 1 is an exploded view of a card connector in accordance with the present invention.

Referring to FIG. 1, a card connector 2 comprises an insulating housing 3, a plurality of terminals 4 and an ejection mechanism 5.

The insulating housing 3 comprises two side arms 31 and a connecting arm 33 interconnected between the two side arms 31. The side arms 31 each define a guide slot 311 for receiving opposite side edges of an electrical card 6 (FIG. 2) therein thus guiding the electronic card 6 into/out of the card connector 2. The connecting arm 33 has an engaging face 332 and a connecting face 334 and defines a plurality of terminal passageways 331 therein. A pivot connecting means comprises a first post 333 and a second post 335 in the present embodiment formed on a top face of the connecting arm 33. Two recesses 337 are defined at two ends of the connecting arm 33 adjacent to the side arms 31.

The terminals 4 each have an engaging portion 41 and a connecting portion 43 and are received in the passageways 331 with the engaging portion 41 extending beyond the engaging face 332 of the connecting arm 33 to engage with the electronic card 6 and the connecting portion 43 beyond the connecting face 334 of the connecting arm 33 to connect with a printed circuit board (not shown). The ejection mechanism 5 comprises a push device 51, a first drawer plate 53 and a second drawer plate 55. The push device 51 fixing on one side arm 31 of the insulating housing 3 comprises a manual push button 511 at one end of the push device 51 and an opening 512 at the other end. The first drawer plate 53 has two ends on which an actuating end 531 and a second end are formed. The actuating end 531 pivotally connects with the opening 512 of the push device 51 and the second end forms a first ejection end 533. The first drawer plate 53 defines a first hole 535 and a connecting hole 537. The first hole 535 pivotally connects with the first post 333. One end of the second drawer plate 55 is bent upward to form an operating plate 551 received in the connecting hole 537 and the other end forms a second ejection end 553 similar to the first ejection end 533. A second hole 555 is defined between the operating plate 551 and the second ejection end 553 to connect with the second post 335 to make a pivot point. The first ejection end 533 and the second ejection end 553 are received in the recesses 337 of the connecting arm 33.

Figure 2:
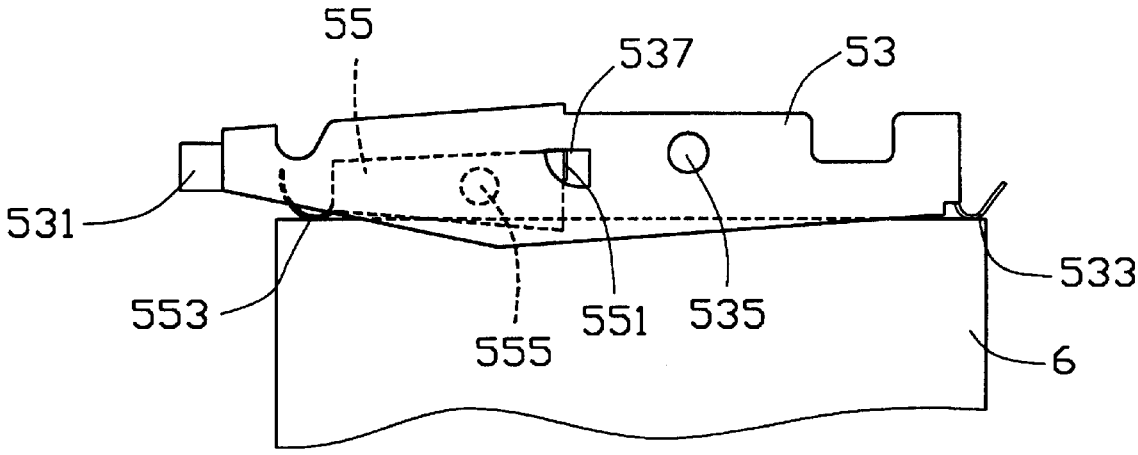
FIG. 2 is a schematic view of an ejection mechanism of the card connector in accordance with the present invention and a card.
Figure 3:
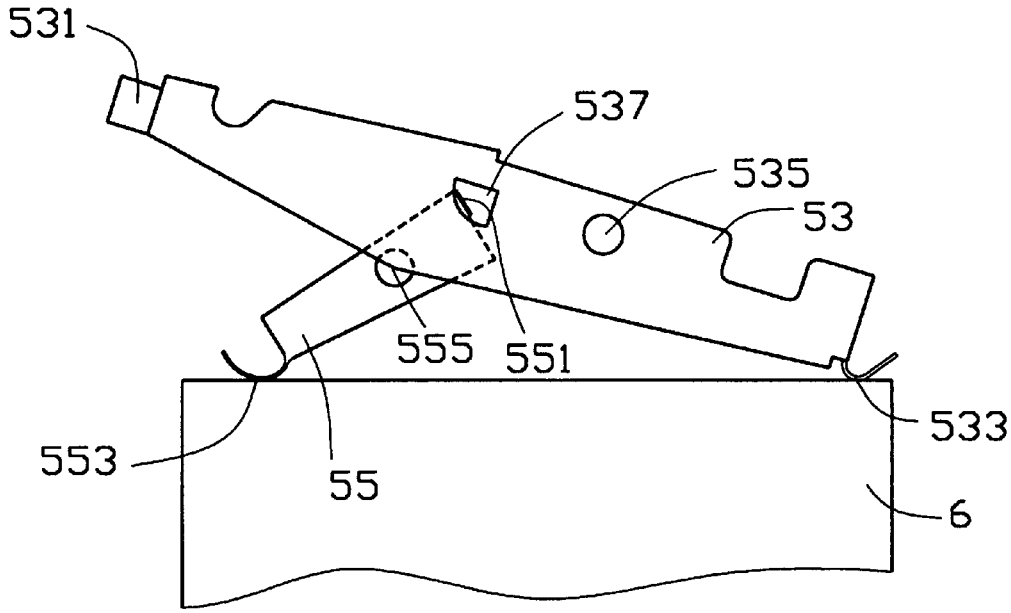
FIG. 3 is a schematic view of the ejection mechanism of the card connector in accordance with the present invention.
Figure 4:
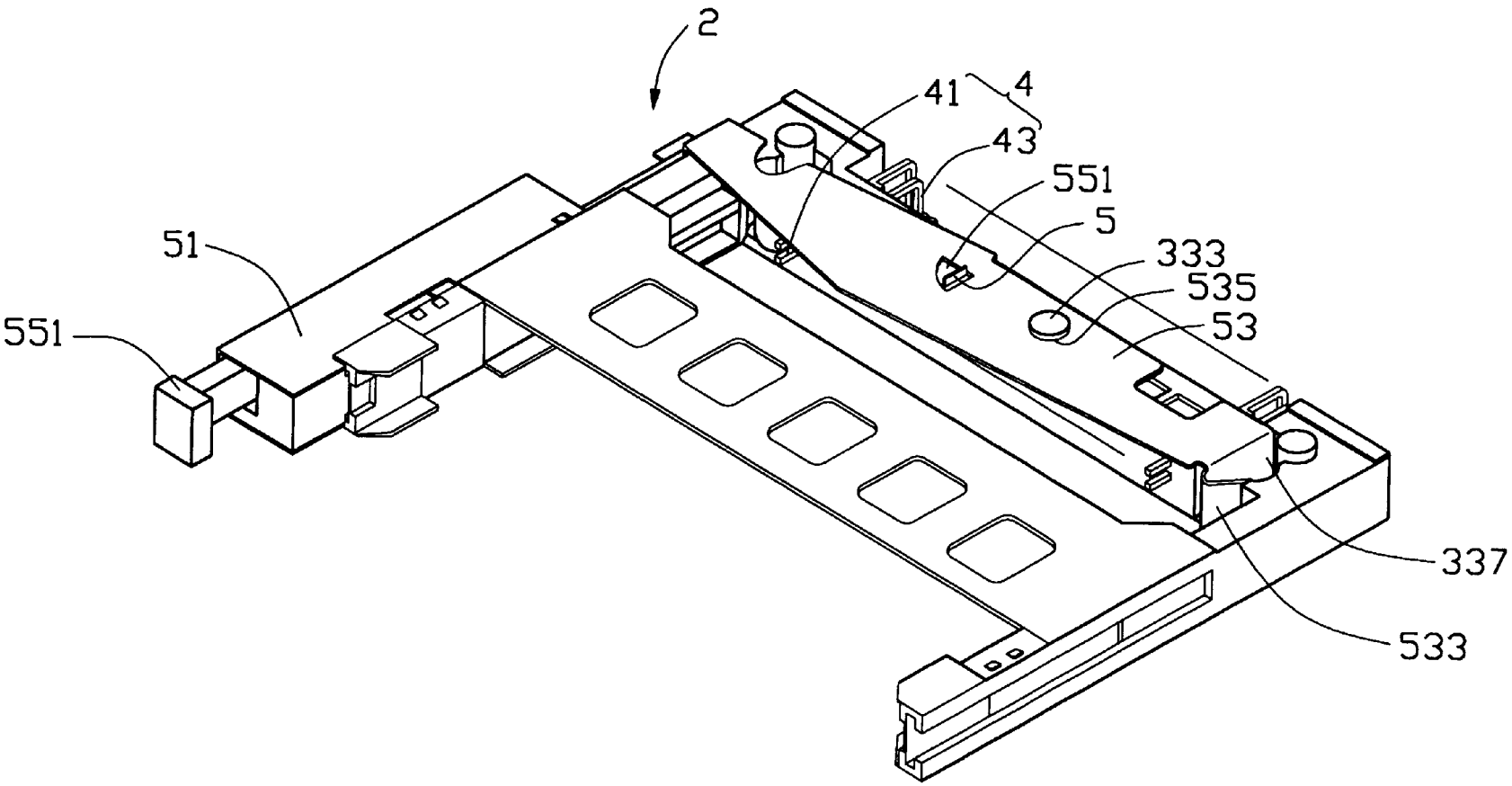
FIG. 4 is an assembled perspective view of the card connector in accordance with the present invention.
Figure 5:
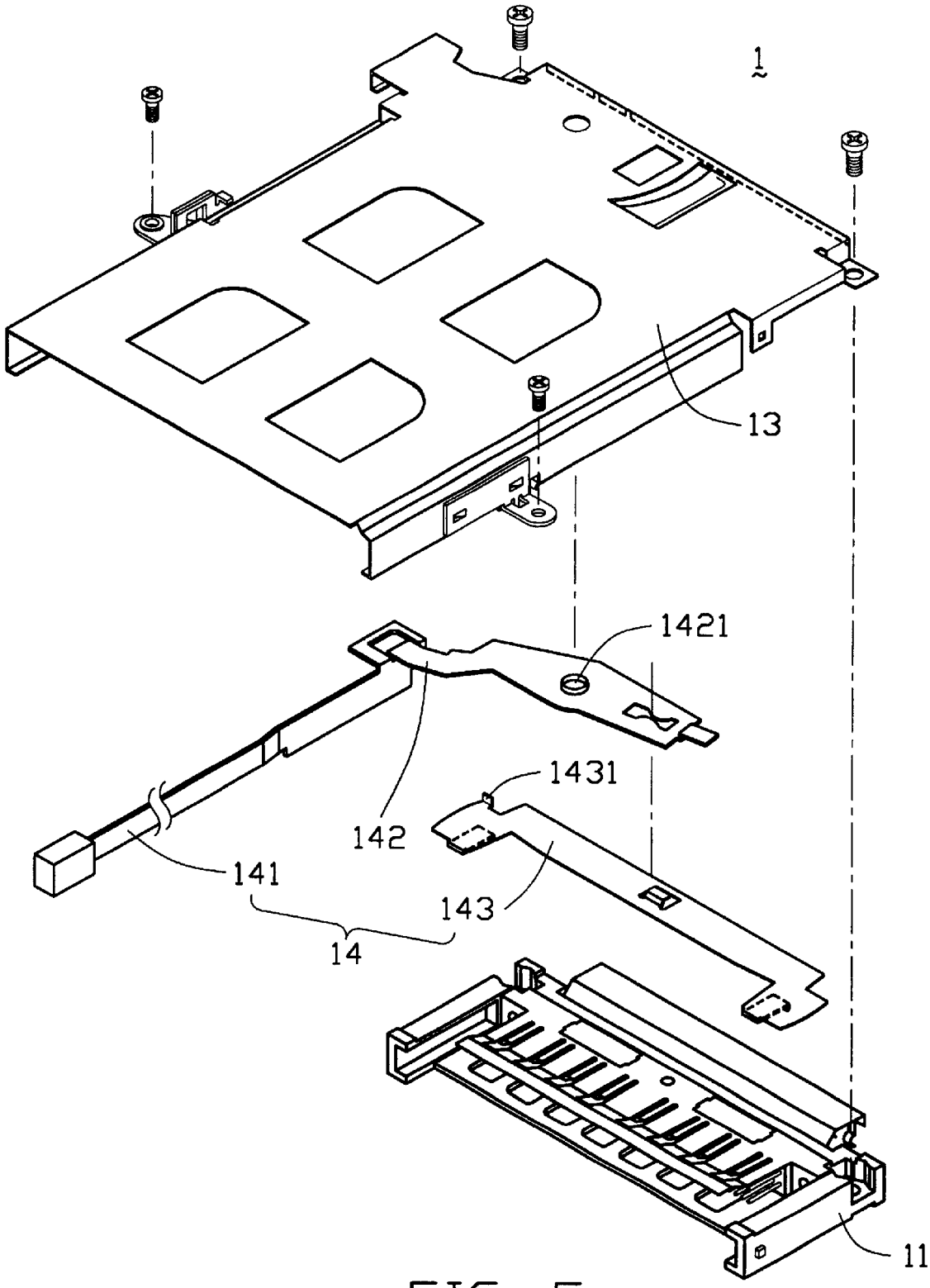
FIG. 5 (PRIOR ART)
FIG. 5 is an exploded view of a prior art card connector.

Referring to FIGS. 2, 3 and 4, it is noted that each of the figures indicates a phase of relationship between the first drawer plate 53 and the second drawer plate 55. The present invention includes several features. Firstly, after the electronic card 6 has been inserted into the card connector 2 via the guiding slot 311 of the side arm 31, the first ejection end 533 of the first drawer plate 53 and the second ejection end 553 of the second drawer plate 55 abut against the electronic card 6.

Secondly, if the manual push button 511 of the push device 51 is pushed forwardly, the opening 512 of the push device 51 will drive the actuating end 531 of the first drawer plate 53 rotating about the first post 333 (first hole 535), whereby the second drawer plate 55 rotates about the second post 335 (second hole 555). The actuating end 531 and the connecting hole 537 moving forwardly will drive the first ejection end 533 and the second ejection end 553 moving backwardly to release the electronic card 6 out of the card connector 2. The two ejection ends 533, 553 abut against the card 6 all the time, so the electronic card 6 will be ejected out of the card connector 2 accordingly.

After the electronic card 6 is inserted into the card connector 2, the electronic card 6 will cause the first plate 53 and the second plate 55 back to the phase shown in FIG. 2.

Also an ejection mechanism of a card connector in accordance with the present invention may be fixed in other ways. For example, the card connector further comprises a shield having a pivot means which may be a pair of through holes, and the ejection mechanism has a pivot device which may be a pair of posts pivotally connected with the through hole. After positioning the shield on an insulating housing of the card connector, an electronic card may be ejected out of the card connector in the same way as the above-mentioned embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

an insulating housing having two side arms and a connecting arm integrally formed with said side arms, a guiding slot being formed on each side arm for guiding an electronic card, said connecting arm defining a plurality of terminal passageways;

a plurality of terminals received in said terminal passageways; and an ejection mechanism comprising a push device mounted to one of the two side arms, a first drawer plate pivotally mounted to the connecting arm and a second drawer plate pivotally mounted to the connecting arm, said first drawer plate having a connecting hole, an actuating end at one end thereof and a first ejection end at the other end thereof, said second drawer plate having at one end thereof an operating plate and at the other end thereof a second ejection end, said operating plate being vertically extended from said one end of said second drawer plate into said connecting hole to pivotally connect with said connecting hole of said first drawer plate; wherein the push device is operable to push the actuating end of the first drawer plate to effectuate a pivotal movement of the first drawer plate and therefore a pivotal movement of the second drawer plate to simultaneously advance the first and the second ejection ends for ejecting the electronic card.

2. The card connector as claimed in claim 1, wherein said connecting arm defines a first post and a second post on a top face thereof, said first drawer plate has a first hole and said second plate has a second hole engaging with said first and said second posts respectively.

3. The card connector as claimed in claim 2, wherein said connecting arm of said insulating housing defines two recesses at two ends thereof for receiving said first and said second ejection ends.

4. An ejection mechanism for use with a card connector, comprising:

a first pivotal drawer plate defining a first pivot thereof;

a first ejection end and an actuating end respectively disposed by two side of said first pivot, a connecting hole being defined between said actuating end and the first pivot, a distance between the first pivot and the actuating end being longer than that between the first pivot and the first ejection end for engagement with one side of a card;

a push device connected to said actuating end; and a second drawer plate defining a second ejection end for engagement with other side of said card, and a link end opposite to the second ejection end, said link end having an operating plate, the operating plate being vertically extended from the link end of the second drawer plate into the connecting hole to pivotally connect with said connecting hole of the first drawer plate so that said second drawer plate is moved along with the first drawer plate when said first drawer plate is rotatably moved by said push device.

5. The mechanism as claimed in claim 4, wherein said second drawer plate includes a second pivot positioned between said second ejection end and said link end.

* * * * *